United States Patent [19]

Brandt

[11] 4,292,904

[45] Oct. 6, 1981

[54] FURNACE AND BOILER SYSTEM AND METHOD OF OPERATION THEREOF

[76] Inventor: Cecil R. Brandt, P.O. Box 35, Westfield, Ill. 62474

[21] Appl. No.: 130,088

[22] Filed: Mar. 13, 1980

[51] Int. Cl.[3] ..... F23B 1/10

[52] U.S. Cl. ..... 110/198; 110/103; 110/186; 110/206

[58] Field of Search ..... 110/185, 186, 198, 103, 110/206

[56] References Cited

U.S. PATENT DOCUMENTS

| | | | |
|---|---|---|---|
| 1,135,913 | 4/1915 | Nye | 110/207 |
| 1,357,441 | 11/1920 | Burda | 110/206 |
| 1,679,909 | 8/1928 | Michael et al. | 110/188 |
| 1,681,382 | 8/1928 | Torkelson | 110/206 |
| 2,386,193 | 10/1945 | Butts | 122/391 |
| 3,481,538 | 12/1969 | Dines | 110/103 X |
| 3,485,191 | 12/1969 | Christman | 110/207 |
| 3,538,865 | 11/1970 | Lausmann | 110/204 |
| 3,742,873 | 7/1973 | Shinpoch | 110/204 |
| 3,799,077 | 3/1974 | Lowe | 110/193 |
| 4,089,278 | 5/1978 | Brandt | 110/206 |

*Primary Examiner*—Edward G. Favors
*Attorney, Agent, or Firm*—Albert L. Jeffers; Roger M. Rickert

[57] ABSTRACT

A furnace system, especially a coal burning furnace and boiler system, in which the coal to be burned is placed on a grate at the bottom of the combustion chamber. According to the invention, automatic means are provided for supplying the coal to the boiler in response to the demands of the boiler. In addition, the boiler system of the present invention includes new and improved means for heating water to about 180° F. to produce steam for use in generating power, such as in a steam locomotive railroad engine pulling up to at least 150 cars. The present invention also, in addition, provides the steam generating raw and distilled water supplies in indirect heat exchange closely adjacent the boiler in order to take advantage of the boiler for maintaining heating of the water supplies. Furthermore, the boiler system of the present invention provides means for recycling the combustion gases back into the combustion chamber whereby to enhance the heat producing efficiency of the boiler system.

4 Claims, 6 Drawing Figures

TO GENERATOR
DISTILLED WATER
TO DISTILLED WATER TANK

FURNACE AND BOILER SYSTEM AND METHOD OF OPERATION THEREOF

BACKGROUND OF THE INVENTION

The present invention relates to a furnace system especially to coal burning furnace systems and to a method of operation thereof.

Reference is particularly made to my U.S. Pat. No. 4,089,278. In this U.S. patent I disclose apparatus and methods for enhancing the combustion of the flue gases and solids of the coal. In addition, I disclose a method by which water in a boiler may be heated by virtue of heat transfer through the combustion chamber flue walls or sheets.

One of the problems associated with the furnaces of the prior art was that the coal was not fed to the combustion chamber efficiently resulting thereby in a greater heat production loss than may be required for particular applications, such as in coal fired steam boiler systems capable of replacing diesel powered systems in railroad locomotives in order to generate electrical power for the locomotive's various uses.

Because of the known size requirements of railroad locomotives, the device claimed in my aforementioned patent presented installation problems in confined spaces, such as in the railroad locomotive engine housing space.

SUMMARY OF THE INVENTION

According to the present invention, a furnace system is provided which may be substantially conventional in construction and configuration to fit within the confines of a conventional diesel engine housing and which includes a combustion chamber having a grate near the bottom on which the fuel or coal is placed to be burned and from which combustion chamber the gases are removed by a stack from the upper portion thereof. The stack is covered and sealed.

Also in accordance with the present invention an automatic coal feed system is provided which will efficiently deliver coal to the combustion chamber in response to the demand of the boiler system automatically.

Another feature of the present invention resides in the locating of both the raw water tank and the distilled water tank in close indirect heat exchange proximity to the boiler whereby the furnace heat will have a thermodynamic influence on the temperature of the raw water tank and contents thereof as well as the distilled water tank and contents thereof.

In addition, the boiler system of the present invention takes advantage of the flue gas flow features of my above-mentioned U.S. Pat. No. 4,089,278 because of repeated combustion of the flue gases which otherwise would not be possible without the boiler system to be described hereinafter.

The present invention also reduces considerably the conduit or flow line systems required for the utilization of the present invention, as compared with the conduit systems of my aforementioned patent, without reducing the efficiency of the boiler system but, indeed, enhancing the efficiency thereof.

By virtue of the present invention, a compact boiler system is provided which may be readily installable in a locomotive housing as a replacement for current diesel powered locomotive engine systems which will by steam power generate comparable electrical power generation and provide fuel energy savings, while at the same time reducing air pollution and noise, compared to such diesel powered engines. Moreover, exhaust generator steam is transmitted to the raw water tank for redistillation for recycling through the steam boiler system continuously. This steam generated and regenerated by the boiler can be used to operate the electrical generator or for any other purposes required in the operation of the locomotive or other components of the locomotive train system.

It is, therefore, an object of the present invention to provide a substantially pollution free, highly efficient boiler combustion chamber and boiler system.

Another object of the present invention is to provide such a boiler system which is portable.

Still another object of the present invention is to provide a boiler system in combination with a boiler construction for efficient conversion of water to steam throughout the boiler system heated by the furnace system.

Another object of the present invention is to provide an automatic feed system for the fuel to the fire box system in response to the demands of the furnace system.

Another object of the present invention is to provide a method for efficient burning of fuel in a fire box combustion chamber.

Still another object of the present invention is to combine a furnace system with a water boiling system and a flue gas burning system, all in a compact unit.

Another object of the present invention is to provide a method for automatically feeding fuel to a combustion chamber.

These and other objects, features and advantages of the present invention will become readily apparent to one skilled in the art from a careful consideration of the following detailed description, when considered in conjunction with the accompanying drawing wherein like reference numerals refer to like and corresponding parts throughout the several views.

DESCRIPTION OF THE PREFERRED EMBODIMENT

Figures 1, 2:
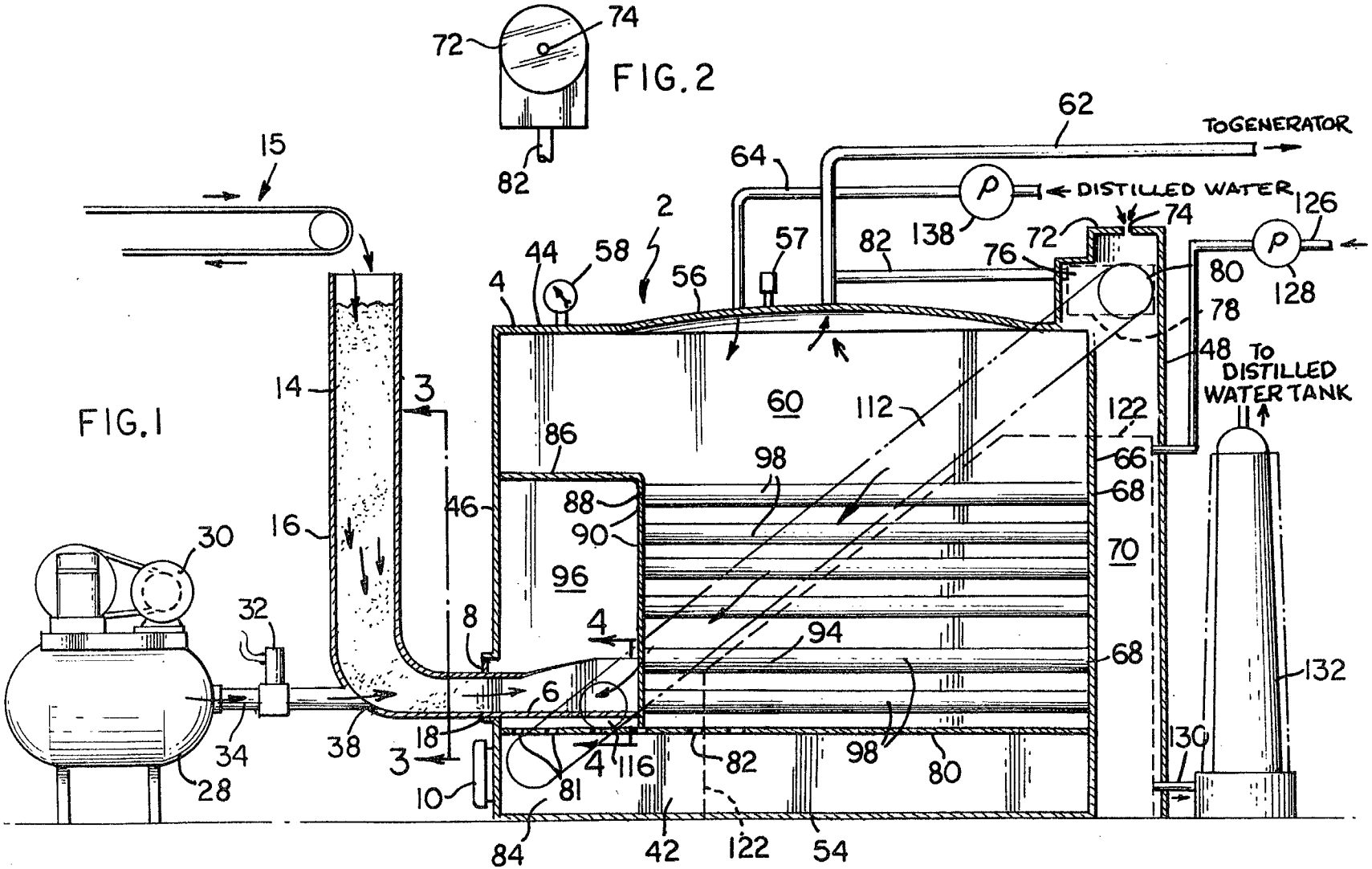
FIG. 1 is a side elevational view, partially broken away and partially schematic of a preferred embodiment of the present invention.
FIG. 2 is a partial top view of the upper right hand portion of FIG. 1.
Figure 6:
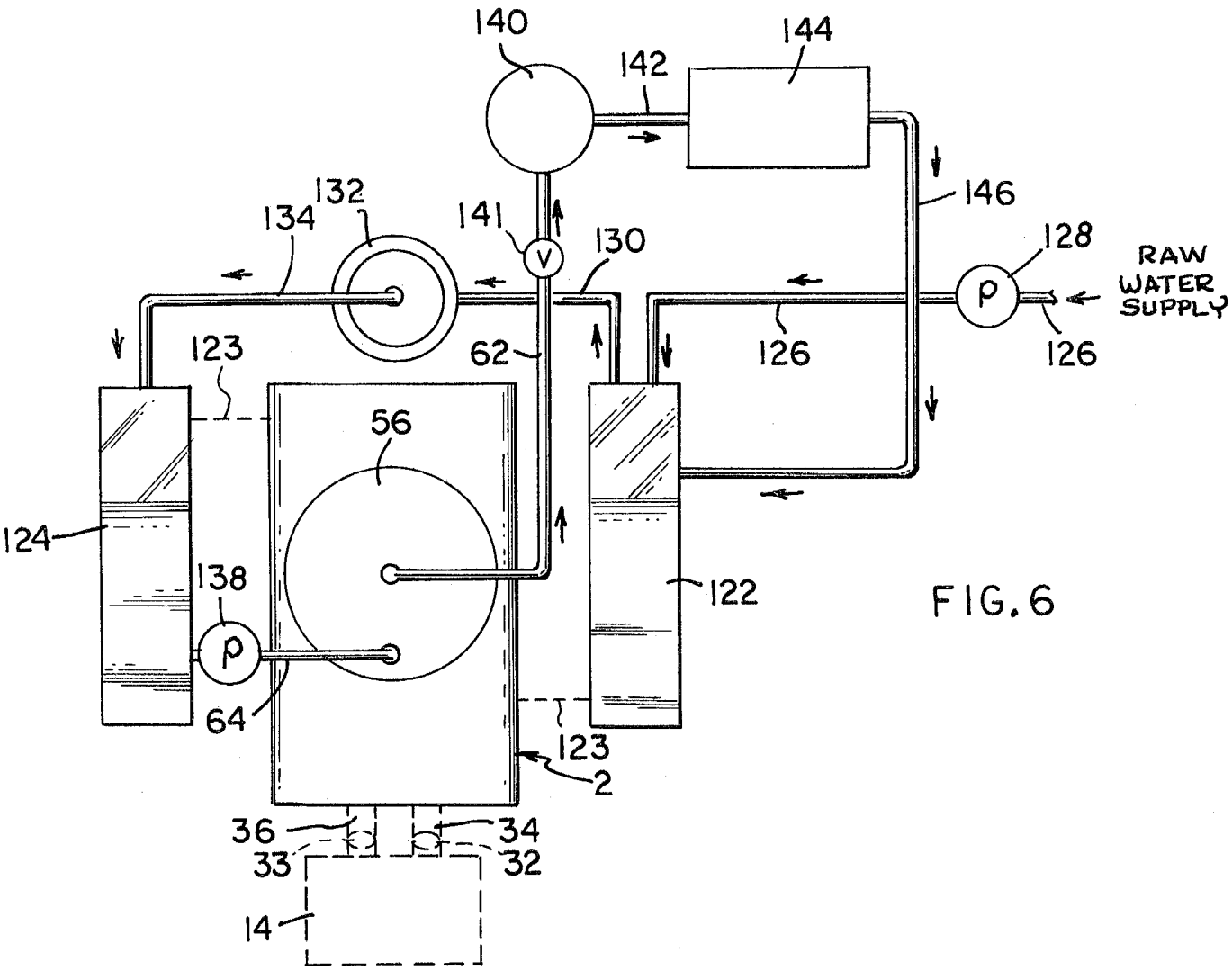
FIG. 6 is a schematic illustration of the overall arrangement of the system of the present invention.

Referring to FIGS. 1, 2 and 6, there is shown a boiler system, generally identified by the numeral 2, which includes a jacket 4 which is insulated by means conventional in the art. The boiler system 2 is adapted for installation in a locomotive engine housing of the diesel type. The outer jacket 4 may itself form part of the combustion chamber of the furnace system and includes a grate 6 on which the coal fuel to be burned is disposable and from which the ash drops down to an ash pit.

The coal is introduced into the combustion chamber within the housing or jacket 4 by means of a fuel door 8 (FIGS. 1 and 5) and ashes can be removed from the system from beneath the grate 6 by means of an ash door 10 which, according to conventional practice, may include a draft door 12 therein through which fresh ambient air can be introduced into the space beneath the grate 6.

Figure 3:
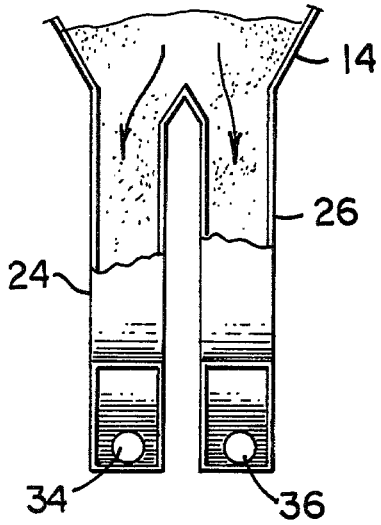
FIG. 3 is a fragmentary sectional view taken along line 3—3 of FIG. 1.
Figure 4:
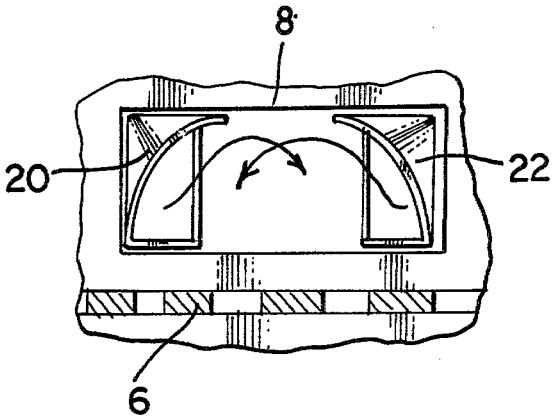
FIG. 4 is a fragmentary sectional view taken along line 4—4 of FIG. 1.

In accordance with the present invention a new and improved automatic coal feed system is employed which includes a generally gravity feed coal bin or hopper 14 having a bifurcated outlet conduit system 16 with inlets in door 8 to the combustion chamber area and grate area 6 (FIGS. 1 and 3). The outlet conduit system 16 supplies coal into the grate 6 area with the assistance of a left-hand coal diffuser or dispenser 20 (FIG. 4) and a corresponding righthand coal diffuser or dispenser 22. The dispensers 20 and 22 are designed to distribute the fuel on the grate 6.

As aforesaid, the coal feed conduit system is bifurcated (FIG. 3) with the right-hand conduit 26 and left-hand conduit 24 is open communication with the fuel door inlet 8.

In accordance with the present invention the coal, which is preferably powdered or finely crushed is supplied to the hopper 14 by conveyor system 15. Depending upon the demand of the combustion chamber and in response to a feedback signal (not shown) compressed air from a compressed air system tank 28 operated by a belt driving motor 30 supplies air through spaced conduits 34 and 36 (FIG. 3) into the conduits 24 and 26 to supply the coal from the conduits 24, 26 to the grate 6.

Supply of air from the tank 28 is controlled by a pair of normally closed solenoid valves 32 and 33 which are located in the lines 34 and 36 (FIG. 6). Thus the control feed system can maintain the most desired efficient coal supply to the combustion chamber and grate 6 by opening of the normally closed valves 32 and 33 in response to the demand of the combustion chamber which may be predicated on volume, heat, pressure, or any other parameter in order to cause opening of the valves 32 and 33 to permit flow of the compressed air to carry the coal in the conduits 24 and 26 onto the grate 6. Solenoid valves which are known to open in about 3 seconds are known to be commercially available and usable for this system.

It will be appreciated that below the grate 6 is an ash pit accessible for cleaning thereof. Referring again to FIG. 1, it will be observed that the furnace 2 outer jacket 4 has a top wall 44 and end walls 46 and 48 with side walls 50 and 52 (FIG. 5) and a bottom wall 54. The side walls 50 and 52 are convexly arcuately curved at their upper portions and are joined by a furnace dome 56. Attached to the top adjacent to dome 56 is a pressure gauge 58. The dome 56 is in fluid communication with a boiler chamber 60. The boiler 60 is provided with an outlet 62 in the dome 56. The boiler inlet 64 also communicates with the dome 56.

Adjacent to and horizontally spaced from the wall 48 is a vertical flue sheet wall 66 having a plurality of apertures 68 formed therein. The horizontal spacing between wall 48 and sheet 66 defines a smoke stack chamber 70 for exhaust of flue combustion gases.

The stack 70 has a top 72 formed with an orifice 74 and the orifice 74 is preferably a fractional part of about 1% of the stack area. In the disclosed embodiment mounted in the upper portion of the stack 70 is a conventional steam powered motor 76 having water cooled bearings and a rotatable drive shaft 78. Also mounted in the upper end of stack 70 immediately adjacent the motor 76 is a fan or blower 80 mounted to shaft 78 and rotatably driven thereby. Motor 76 may be any of commercially available steam motors well known to the art. A pipe 82 provides fluid communication between the outlet 62 and the motor 76 to provide the necessary steam power for operation of the motor 76 or, if desired, an electric motor can be used. A fan speed of around 2,200 RPM is preferred.

Mounted between the end wall 46 and the flue sheet wall 66 is a bottom plate 80 having apertures 81 therein forming an ash pit 84 between the bottom floor 54, the plate 80 and the flue wall 66. This ash pit is vented to the atmosphere to allow the escape of completely burned material.

A horizontal flue plate sheet wall 86 extends between the walls 50 and 52 and is connected to wall 46. The flue plate sheet wall 86 is joined to a vertical flue plate sheet wall 88 having a plurality of apertures 90 therein, the sheet 88 also extends between the walls 50 and 52 and is connected thereto. At its bottom end the wall 88 is connected to plate 80 which also extends between the walls 50 and 52. The sealed walls 86 and 88 form the combustion chamber 96.

Mounted between the sheets 88 and 66 in fluid type relation with the corresponding aligned apertures 68 and 90 are a plurality of round flues 98 which are inserted in their corresponding apertures 68 and 90. A mandrel is forced in each flue to expand the flue ends in fluid sealing relation against the periphery of the openings or apertures 68, 90 and then the flue ends are beaded outwardly against the corresponding sheet 88 and 66 to provide a fluid tight joint. Of course, other methods of providing fluid tight joints may be employed. Thus formed, the flues 98 provide communication for flow of hot combustion gases from the chamber 96 to the stack 70.

The boiler 60 is thus formed in the furnace 2 between the combustion chamber 96 and the stack 70 and is defined by the sheets 86, 88, the bottom plate 80, the flue sheet 66, the walls 46, 50 and 52 and the top wall 44.

Figure 5:
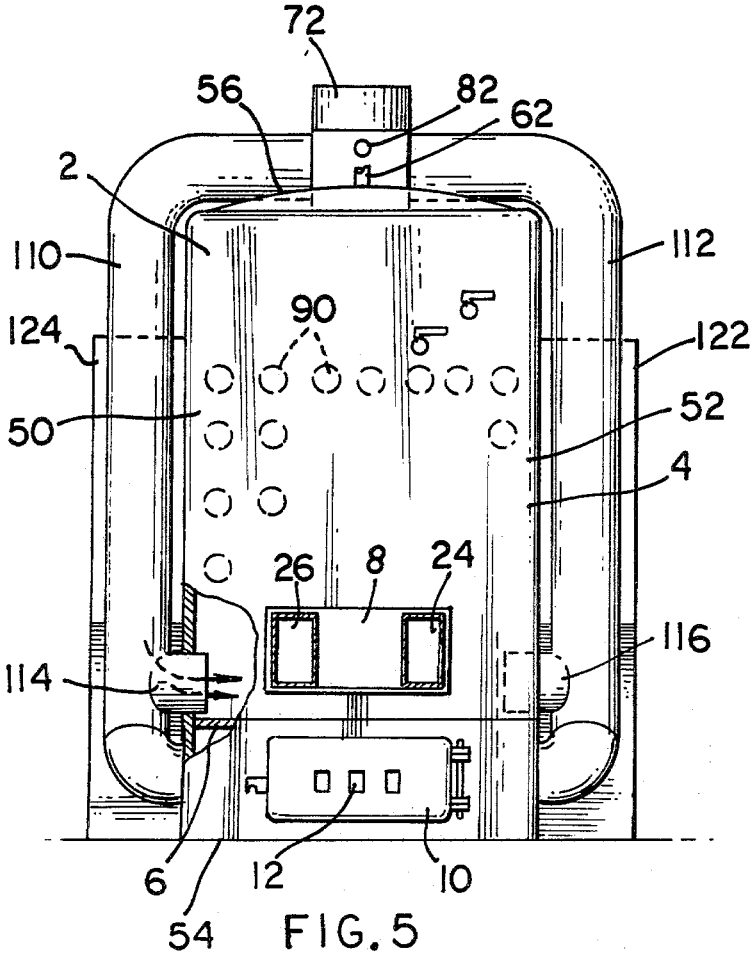
FIG. 5 is a front elevational view of a boiler constructed in accordance with the present invention.

Formed on either side of the furnace 2 are down-comer tubes 110 and 112 (FIGS. 5 and 1). The upper ends of the tubes 110, 112 are in fluid communication with the discharge side of the blower 80 and adjacent the lower ends of the tubes 110, 112 are formed branch pipes 114, 116, respectively which provide fluid communication between the tubes 110 and 112 and the combustion chamber 96 just above the grate 6. The lower ends of the tubes 110 and 112, respectively, as is apparent, are open and are disposed in the ash pit for disposal of and removal of any ash.

In the preferred embodiment of the invention the down-comer tubes 110 and 112 are located closely adjacent the furnace 2 for indirect heat exchange between these tubes 110 and 112 and the fire box.

The furnace system of the present invention also includes, as clearly appears in FIG. 6, a raw water tank 122 shown schematically and a distilled water tank 124 also shown schematically, both of which have sloped top walls (one of which 122 is shown in dotted lines). These tanks 122 and 124 are located also closely adjacent the furnace as illustrated by dotted lines 123 in order to maintain a heat exchange relationship between the furnace and the tanks 122 and 124. Raw water is supplied from a source, not shown, through a pipe or conduit 126 and is supplied to the raw water tank 122 under the influence of a pump 128. The level of raw water in the tank 122 is maintained in accordance with any known level control device.

From the raw water tank 122 the raw water flows through line 130 into a conventional distilled water still or generator 132.

From the distilled water still 132 the now distilled water flows through line 134 to the distilled water tank 124. From the distilled water tank the distilled water at 180° F. flows through line 64 under the influence of a pump 138 into the boiler 60. The distilled water is converted into super heated steam at around 600° F. in the boiler 60 and flows from the dome 56 through the line 62 to a generator or other steam powered device, such as indicated at 140 in FIG. 6.

The exhaust steam from the generator 140 flows over line 142 into a condensing tank 144 of conventional construction. From the condensing tank 144 the water flows over a line 146 into the raw water tank 122 to repeat the cycle. Line 142 is preferably of a large diameter, say 6 to 8 inches, so as to not cause any undesirable back pressure.

In operation, the pump 138 supplies distilled water into the boiler 60 to a predetermined level. The fuel combustion will cause heating of the water in boiler 60 through heat exchange contact with the walls 86, 88, 92 and 94. The hot combustion gases are drawn through the flues 98 and stack 70 under the influence of blower 80 raising the flue 98 temperatures approximately to the temperature of the combustion gases thereby additionally heating the water in the boiler 60. The combustion gases are drawn by blower 80 and discharged into tubes 110 and 112 wherein the gases are forced downwardly into the pipes 114 and 116 and back into the combustion chamber 96 at approximately the level of the burning fuel and above the flame center wherein the return combustion gases are recycled into the combustion zone. Thus, substantially complete combustion of the gases is provided in this manner. The ash particles in the stack 70, due to their mass, flow above the tubes 110 and 112 to the top of the stack 70 wherein they are met by a stream of cold ambient air through the orifice 74. The particles are cooled and the sulphur containing particles of the fuel are chemically and thermodynamically neutralized by the incoming ambient air and moisture after reaching the upper portion of stack at 72 are drawn downwardly by blower 80 into tubes 110 and 112 wherein they follow the lower surfaces of tubes 110 and 112 to the bottom portion thereof and are collected in the ash pit by gravity flow. Thus, those portions of the combustion gases which are lighter in mass are recycled into the combustion chamber 96 for reburning and the heavier ash particles are collected against the covers 118 and 120 but basically by the suction of the fan remove the fly ash.

The temperatures in the boiler 60 are sufficiently high say 600° F., to generate steam above the predetermined water level which steam passes through the line 62. Steam from boiler 60 is also conducted through pipe 82 to power the motor 76. Water from the boiler 60 may also be drawn through outlet means (not shown) for possible use in a hot water heating system or, for other comparable uses.

When the water level in the boiler 60 falls below the predetermined desired level, the pump 138 (FIG. 6) is automatically actuated to pump additional hot water from the tank 124 into the boiler until the predetermined level in the boiler 60 is reestablished.

Various conventional features may, of course, be incorporated into the system. Thus a control valve 141 may be placed in the line from the boiler to the generator 140 and a safety valve 57 may be placed in this line or directly on the boiler. An electrically controlled visible monitoring and control panel is contemplated.

While there have been disclosed particular embodiments of the present invention, other embodiments will become readily apparent to one skilled in the art and, accordingly, this invention should be considered to be limited in scope only by the accompanying claims.

What is claimed is:

1. In a combination furnace system, combustion chamber means located adjacent the bottom of said furnace for supporting combustible fuel material to be burned, supply means for supplying combustible fuel material to said combustion chamber means, said supply means including compressed air means for carrying and directing combustible fuel material into said combustion chamber means in response to the demand of the furnace system, means for receiving burned fuel and ash for discharge from said furnace system, water source means for introducing distilled water into associated furnace boiler means to produce steam from said distilled water in the system in response to a demand generated by steam demand means connected to said furnace system, and means for generating a work output in response to steam pressure delivered by said furnace system in response to said steam demand means, a pair of spaced down-comer tube means for recirculation of gases and ash generated by said furnace system to said combustion chamber means, said down-comer tube means being located adjacent the furnace system in heat transfer relationship thereto and in part in proximity to said water source means and in heat transfer relation therewith, raw water tank means adjacent one side of and in heat transfer relationship with said furnace and in part to said down-comer tube means, said water source means being located adjacent the opposite side of the furnace for indirect heat exchange therewith.

2. The system of claim 1 including steam condensing means adapted to receive the steam from said output generator means for return of said steam to said water source means and, means for condensing and distilling said recirculated steam generated water for return and recycling to said furnace system.

3. The system of claim 1 wherein the down-comer means also overlie the water source means and raw water tank means for heat exchange therewith.

4. The system of claim 1 wherein the inlets of said down-comer tube means is located adjacent the top surface of said furnace.

* * * * *